US010151111B1

(12) United States Patent
Porter

(10) Patent No.: US 10,151,111 B1
(45) Date of Patent: Dec. 11, 2018

(54) CONCRETE BLOCK INSULATION

(71) Applicant: CFI FOAM, INC., Knoxville, TN (US)

(72) Inventor: Richard Ayers Porter, Knoxville, TN (US)

(73) Assignee: CFI FOAM, INC., Knoxville, TN (US)

( * ) Notice: Subject to any disclaimer, the term of this patent is extended or adjusted under 35 U.S.C. 154(b) by 0 days.

(21) Appl. No.: 15/728,052

(22) Filed: Oct. 9, 2017

(51) Int. Cl.

| | |
|---|---|
| ***E04B 1/74*** | (2006.01) |
| ***E04C 1/41*** | (2006.01) |
| ***E04B 2/14*** | (2006.01) |
| ***E04B 1/76*** | (2006.01) |
| *E04B 2/02* | (2006.01) |

(52) U.S. Cl.
CPC ..... *E04C 1/41* (2013.01); *E04B 1/7604* (2013.01); *E04B 2/14* (2013.01); *E04B 2002/0293* (2013.01); *E04B 2103/02* (2013.01)

(58) Field of Classification Search
CPC ... E04C 1/40; E04C 2/04; E04C 2/004; E04C 2/205; E04C 2/284; E04C 2/288; E04C 2/2885; E04C 2/296
USPC .. 52/405.1, 309.4, 309.7, 404.1, 405.2, 294, 52/293.2, 407.1, 405.3, 406.2, 309.12
See application file for complete search history.

(56) References Cited

U.S. PATENT DOCUMENTS 3,557,840 A * 1/1971 Maybee ..... F16L 59/026 138/149
3,885,363 A * 5/1975 Whittey ..... E04B 1/8404 52/125.3
4,027,445 A * 6/1977 Nickerson ..... E04C 1/41 52/309.12
4,073,111 A * 2/1978 Warren ..... E04C 1/41 52/407.1
4,193,241 A * 3/1980 Jensen ..... E04C 1/41 52/125.3
4,380,887 A * 4/1983 Lee ..... B28B 7/162 52/309.4
4,462,195 A * 7/1984 Nickerson ..... E04C 1/41 52/309.4
4,631,885 A * 12/1986 Iannarelli ..... E04C 1/41 52/309.12
5,062,244 A * 11/1991 Ducharme ..... E04C 1/41 52/309.12
5,349,798 A * 9/1994 Gross ..... E04C 1/40 52/309.12

(Continued)

*Primary Examiner* — Chi Q Nguyen
(74) *Attorney, Agent, or Firm* — Luedeka Neely Group, PC

(57) ABSTRACT

An insulation system for a concrete block having an open end and a closed end, the insulation system including a single sheet of a foam material configured to have opposite end portions with a middle portion intermediate the end portions and a hinge defined between each of the end portions and the middle portion to enable the sheet to be folded so that the middle portion is disposed perpendicular to the end portions to render the sheet in a u-shaped orientation so as to be insertable into the open end of the concrete block; and a panel of foam material configured as a rectangle to conform to the closed end of the concrete block. The sheet of foam material is sized to provide a snug interference fit with the open end of the concrete block when folded into the u-shaped orientation and the panel is sized to provide a snug interference fit with the closed end of the concrete block. The sheet of foam material and the panel of foam material are each made of a closed cell flexible foam.

11 Claims, 10 Drawing Sheets

(56) References Cited

U.S. PATENT DOCUMENTS

| | | | | |
|---|---|---|---|---|
| 5,652,039 | A * | 7/1997 | Tremain | B32B 3/04 428/121 |
| 7,386,956 | B2 * | 6/2008 | Argila | E04B 1/70 52/169.5 |
| 7,526,900 | B2 * | 5/2009 | Ehrman | E04B 1/7061 52/169.5 |
| 8,590,243 | B2 * | 11/2013 | Jorgensen | E04C 1/41 52/405.1 |
| 2004/0182037 | A1 * | 9/2004 | Sourlis | E04B 1/644 52/606 |
| 2005/0108955 | A1 * | 5/2005 | Howe | E04H 1/1205 52/79.5 |
| 2009/0032171 | A1 * | 2/2009 | Callear | B32B 3/04 156/92 |
| 2011/0302863 | A1 * | 12/2011 | Sourlis | E02D 19/00 52/302.1 |

* cited by examiner

CONCRETE BLOCK INSULATION

FIELD

This present disclosure relates to insulation materials. More particularly, the disclosure relates to concrete block insulation structures of improved construction and methods for insulating concrete block.

BACKGROUND

In the construction of concrete block walls for dwellings and the like, it is desirable to install rebar reinforcing steel rods at intervals vertically through a hollow core of concrete blocks from a concrete or other footer to a roof line of the wall to tie or connect the top of the wall to the footer. The cores of the concrete blocks that contain the rebar (typically every 48" vertically) are pumped full of grout to strengthen the wall. The concrete blocks are typically manufactured at a block plant and configured to have an open portion and a closed portion.

A need exists in the art for a foam insulation insert to be developed that could be inserted into the open portion of concrete blocks at the block plant. This would allow an insulated block to be provided that could be readily filled with grout during insulation. Conventionally, grout-filled portions of the blocks are not insulated. What is needed is a foam insert that is easy to install, affordable and will stay inserted into the concrete block without falling out.

SUMMARY

The disclosure advantageously provides concrete block insulation structures of improved construction.

In one aspect, the disclosure provides an insulation system for a concrete block having an open end and a closed end. In one aspect, the insulation system includes a single sheet of a foam material configured to have opposite end portions with a middle portion intermediate the end portions and a hinge defined between each of the end portions and the middle portion to enable the sheet to be folded so that the middle portion is disposed perpendicular to the end portions to render the sheet in a u-shaped orientation so as to be insertable into the open end of the concrete block; and a panel of foam material configured as a rectangle to conform to the closed end of the concrete block.

The sheet of foam material is sized to provide a snug interference fit with the open end of the concrete block when folded into the u-shaped orientation and the panel is sized to provide a snug interference fit with the closed end of the concrete block. The sheet of foam material and the panel of foam material are each made of a closed cell flexible foam.

In another aspect, the disclosure provides an insulation system for a concrete block having an open end. The insulation system includes a single sheet of a foam material comprising a sheet of a closed cell flexible foam configured to have opposite end portions with a middle portion intermediate the end portions and a hinge defined between each of the end portions and the middle portion to enable the sheet to be folded so that the middle portion is disposed perpendicular to the end portions to render the sheet in a u-shaped orientation so as to be insertable into the open end of the concrete block. The sheet of foam material is sized to provide a snug interference fit with the open end of the concrete block when folded into the u-shaped orientation.

In a further aspect, the disclosure provides an insulation system for a concrete block having an opening, the insulation system including a closed cell flexible foam has a density of from about 0.5 to about 3.0 lb/ft3, a cell count of from about 10 to about 40 cells/inch, a compressive strength at a 25% deflection of from about 1 to about 10, a compressive strength at 50% of from about 4 to about 20, a water absorption of about 0.25 lb/ft2 or less, a tensile strength of about 10 lb/in2 or more, and a tensile elongation of about 25% or more. The foam is configured to snugly fit within the opening for installation of the foam, and wherein the installed foam remains installed within the opening during transport of the concrete block.

In yet another aspect, the disclosure provides a method for providing insulation for a concrete block at a concrete block plant where the block is manufactured.

The method includes the steps of providing a concrete block having an open end at the plant, and providing insulation for the block in the form of a sheet of a closed cell flexible foam configured to have opposite end portions with a middle portion intermediate the end portions and a hinge defined between each of the end portions and the middle portion to enable the sheet to be folded so that the middle portion is disposed perpendicular to the end portions to render the sheet in a u-shaped orientation so as to be insertable into the open end of the concrete block.

The method also includes the steps of folding the sheet of foam material to provide the sheet in the u-shaped orientation; installing the sheet material in the u-shaped orientation into the open end; and transporting the block with the installed sheet material. The installed sheet material remains firmly installed in the concrete block during transport of the concrete block. In still another aspect, the disclosure provides a method for providing insulation for a concrete block. The method includes the steps of providing a concrete block; and providing insulation for the block.

The step of providing insulation includes providing a closed cell foam dimensioned to snugly fit within an opening of the block, the foam having a density of from about 0.5 to about 3.0 lb/ft3, a cell count of from about 10 to about 40 cells/inch, a compressive strength at a 25% deflection of from about 1 to about 10, a compressive strength at 50% of from about 4 to about 20, a water absorption of about 0.25 lb/ft2 or less, a tensile strength of about 10 lb/in2 or more, and a tensile elongation of about 25% or more.

The method also includes the steps of installing the foam within the opening of the concrete block, and transporting the concrete block with the installed foam. The installed foam remains firmly installed in the concrete block during transport of the concrete block.

BRIEF DESCRIPTION OF THE DRAWINGS

Further advantages of the disclosure are apparent by reference to the detailed description in conjunction with the figures, wherein elements are not to scale so as to more clearly show the details, wherein like reference numbers indicate like elements throughout the several views, and wherein.

DETAILED DESCRIPTION

With initial reference to FIGS. 1A, 1B, 2, 3, 4, and 5, the disclosure relates to an insulation system 10 configured for installation into an open end 12 of a concrete block 14. The concrete block 14 also includes a closed end 16.

Figure 1A:
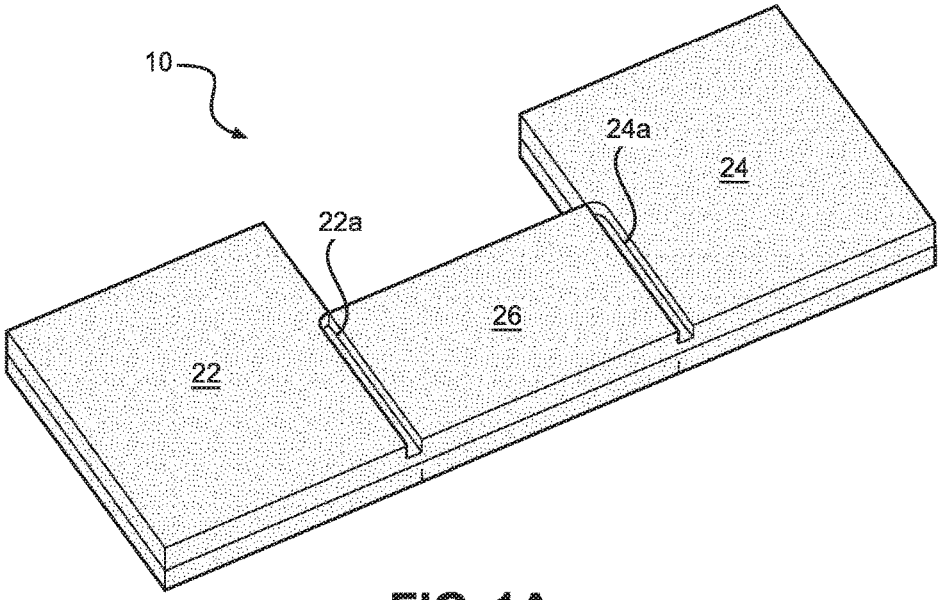
FIGS. 1A and 1B show front and rear views of an insulation system according to the disclosure for an open end of a concrete block, with the insulation system shown in a flat or unfolded orientation.
Figure 1B:
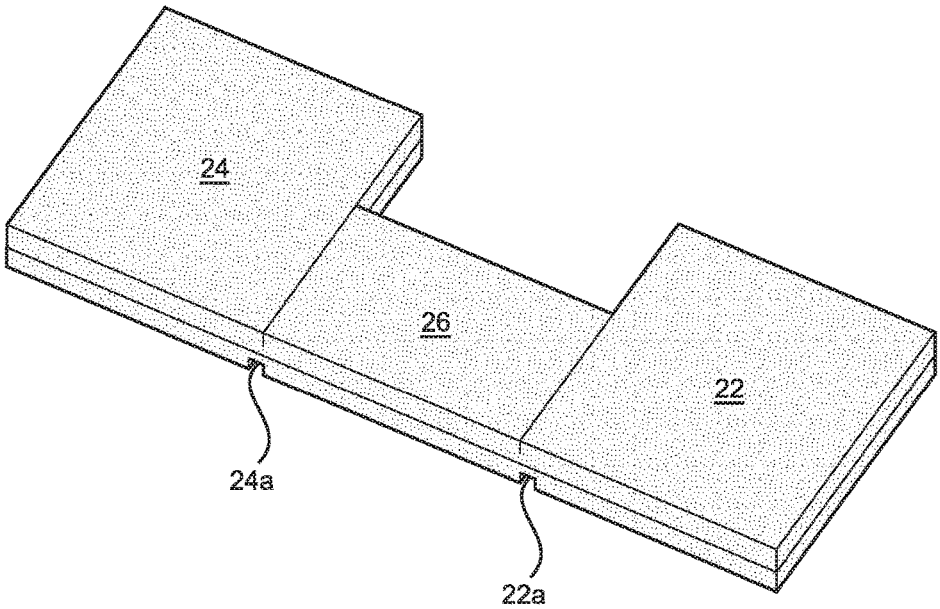
Figure 2:
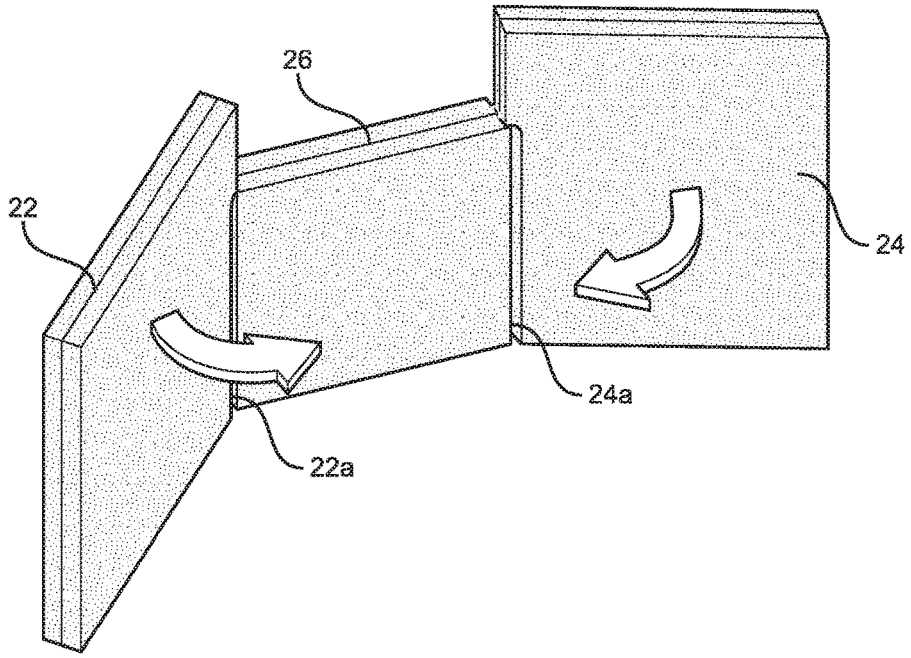
FIG. 2 depicts folding of the insulation system of FIGS. 1A and 1B.
Figure 3:
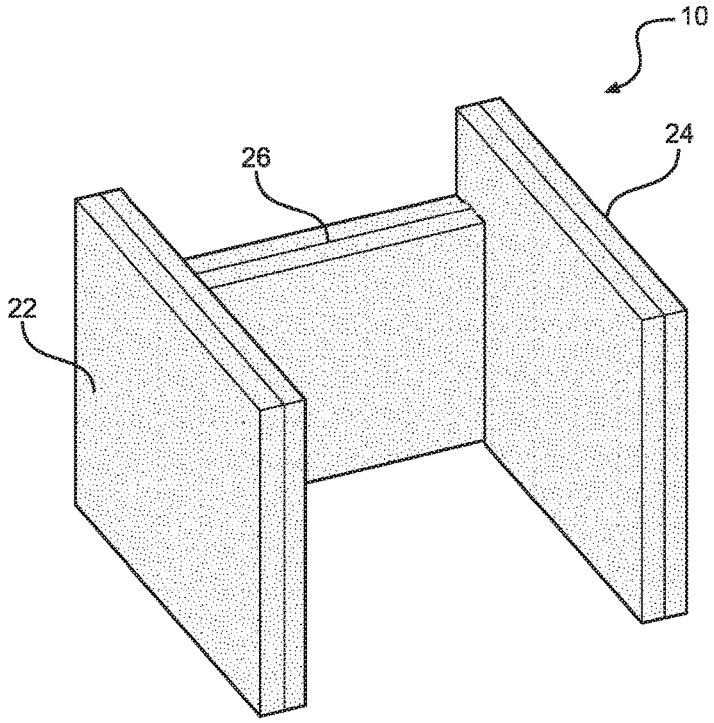
FIG. 3 shows the insulation system of FIGS. 1A, 1B and 2 after it has been folded.
Figure 4:
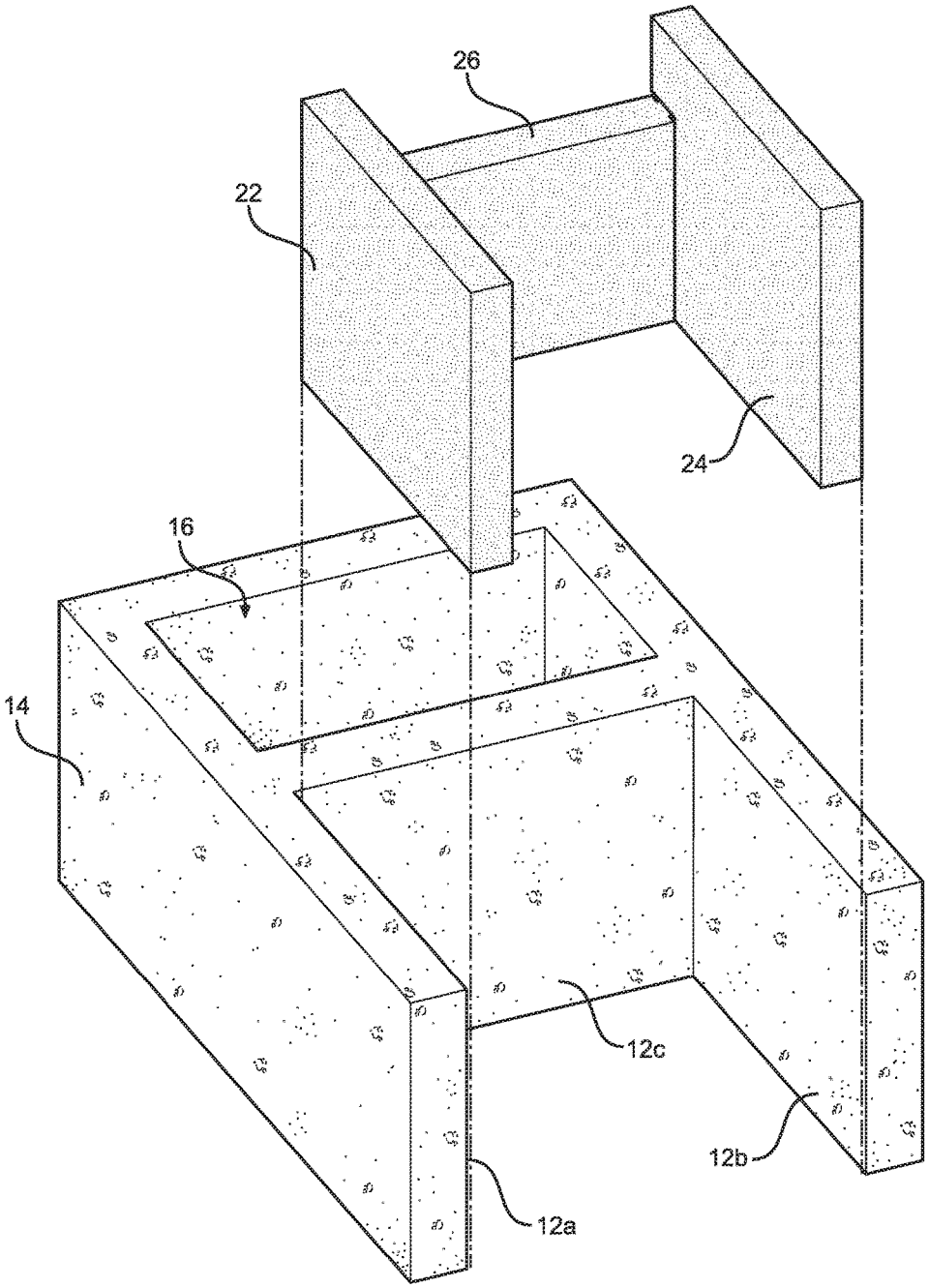
FIG. 4 shows installation of the insulation system of FIG. 3 into an open end of a concrete block.
Figure 5:
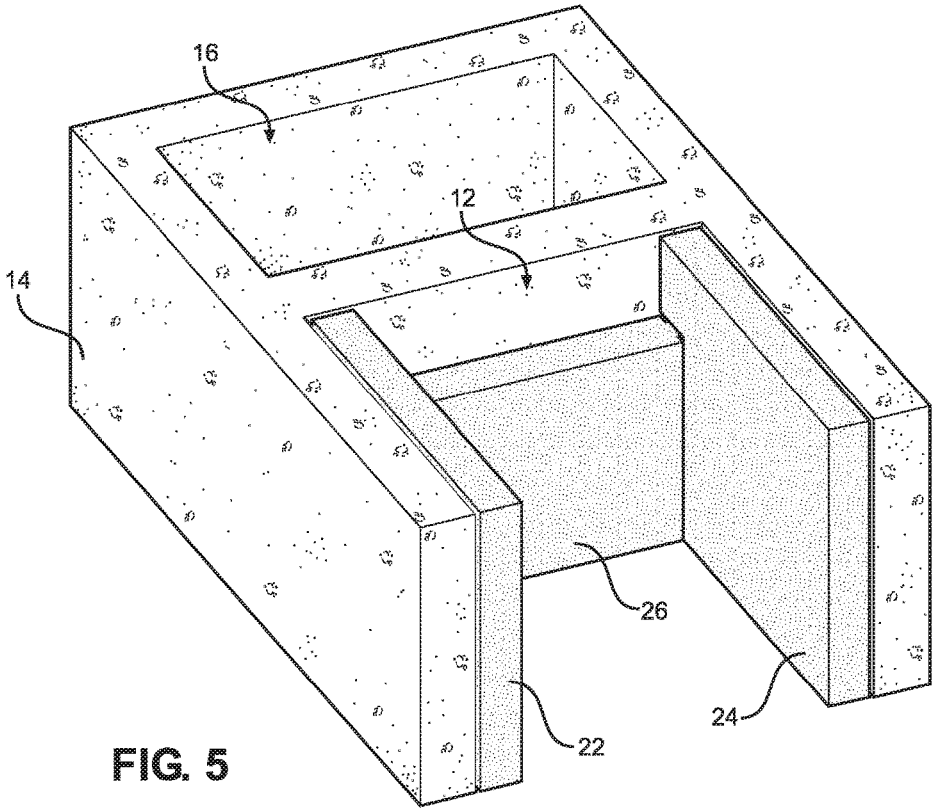
FIG. 5 shows the insulation system of FIG. 3 as installed into an open end of a concrete block.

FIGS. 1A and 1B show the insulation system 10 in a flat or unfolded orientation. FIG. 2 depicts folding of the insulation system 10. FIG. 3 shows the insulation system 10 folded. FIG. 4 shows installation of the insulation system 10 into the open end 12 of the concrete block 14. FIG. 5 shows the insulation system 10 as installed into the open end 12 of the concrete block 14.

As seen, the insulation system 10 is provided by a single sheet of a foam material 20 configured to have opposite end portions 22 and 24, with a middle portion 26 intermediate the end portions 22 and 24. The end portions 22 and 24 are preferably of like dimension and configured to correspond in dimension to sides 12*a* and 12*b* of the open end 12 of the concrete block 14.

A channel 22*a* is defined on one side of the end portion 22 adjacent the middle portion 26. A channel 24*a* is defined on one side of the end portion 24 adjacent the middle portion 26. The channels 22*a* and 24*a* provide clearance for the ends of the middle portion 26 to be received to provide a hinge structure to enable the system 10 to be folded or erected to that the middle portion 26 is disposed perpendicular to the end portions 22 and 24 to render the system 10 in a u-shaped orientation as shown in FIG. 3 for insertion into the open end 12 of the concrete block 14 as shown in FIG. 4.

The middle portion 26 is configured to be shorter in height than the end portions 22 and 24 and configured to lie against end 12*c* of the open end 12 and span between the end portions 22 and 24. Thus, when the system 10 is in the folded or erected orientation, it is sized and configured to snugly and frictionally engage within the open end 12 of the concrete block, as shown in FIG. 5.

It has been observed that foams of the type conventionally used to insulate concrete blocks do not have adequate properties to maintain in frictional engagement with an open end of a concrete block. It has been discovered that a critical aspect of the present disclosure relates to the material utilized to provide the foam material 20.

Preferred foams to provide the foam material 20 are closed-cell foams that are resistant to wicking or absorption of moisture. In particular, polyethylene foam is a preferred foam to provide the foam material. It has been discovered that the use of polyethylene foam configured to provide the insulation system 10 is suitable for installation into the open end 12 of the concrete block 14 at a plant where the concrete block 14 is made, and has sufficient properties, such as firmness, resilience, and coefficient of static friction, to remain firmly installed in the concrete block 14 during shipping and handling of the concrete block. Other suitable foams having similar properties may be utilized, such as neoprene. However, it has been observed that such foams are considerably more expensive.

Figure 6:
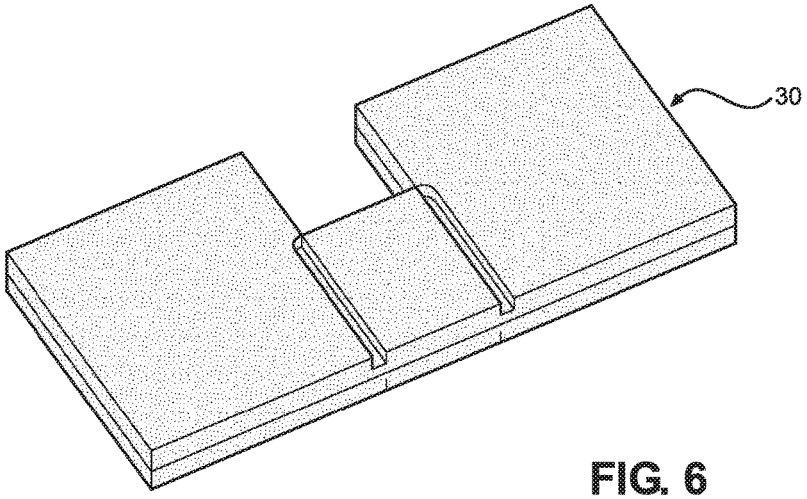
FIG. 6 shows another insulation system for an open end of a concrete block having different dimensions than the system of FIGS. 1A and 1B, and in a flat or unfolded orientation.

FIG. 6 shows an insulation system 30. The insulation system 30 is identical to the insulation system 10 and made of the foam material 20, but configured smaller for a smaller sized concrete block.

The foam material 20 is desirably a closed cell flexible foam having the properties shown below. The properties noted below referenced in ASTM D-3575 "Standard Test Methods for Flexible Cellular Materials Made from Olefin Polymers"

Foam Density Range: 0.5-3.0 lb/ft3, and preferably 0.9-1.0 lb/ft3

There is no direct measure of Coefficient of Friction, however the coefficient of friction has been observed to relate to the size of the foam cells, measured in cells per inch. The foam material 20 is selected to have a cell count (Cells/inch) of 10-40, and preferably 15-25.

Firmness is important because the foam needs to be soft enough to be flexible/workable, but firm enough to resist compressing when the core of the block (containing foam) is grout-filled. Firmness is measured as Compressive Strength at a 25% deflection and 50% deflection. The Compressive Strength at 25% is selected to be 1-10, and preferably 2-7. The Compressive Strength at 50% is selected to be 4-20, and preferably 5-10.

Closed Cell content is important so the foam won't absorb or wick water. This is measured by Water Absorption (lb/ft2). The Water Absorption (lb/ft2) is selected to be <0.25, and preferably <0.10.

Tensile Strength and Elongation are important because they measure overall foam strength, and the foam must be able to withstand being inserted into the block at the block manufacturing plant, being shipped to the jobsite, installed in the wall by the mason contractor, followed by grout-filling the cores. The Tensile Strength (lb/in2) is selected to be >10, and preferably 20-40. Tensile Elongation (%) is selected to be >25, and preferably 60-80.

Figure 7:
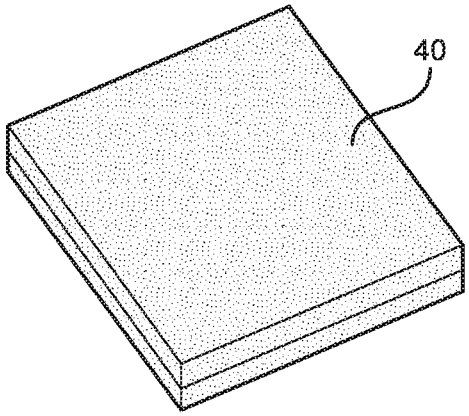
FIG. 7 depicts an insulation panel according to the disclosure for a closed end of a concrete block.

Turning now to FIG. 7, there is shown an insulation panel 40 according to the disclosure for being located in the closed end 16 of the concrete block 14. The panel 40 may be a single sheet of foam material or may be several pieces of foam material glued or otherwise adhered together to provide a desired width or thickness.

Figure 8:
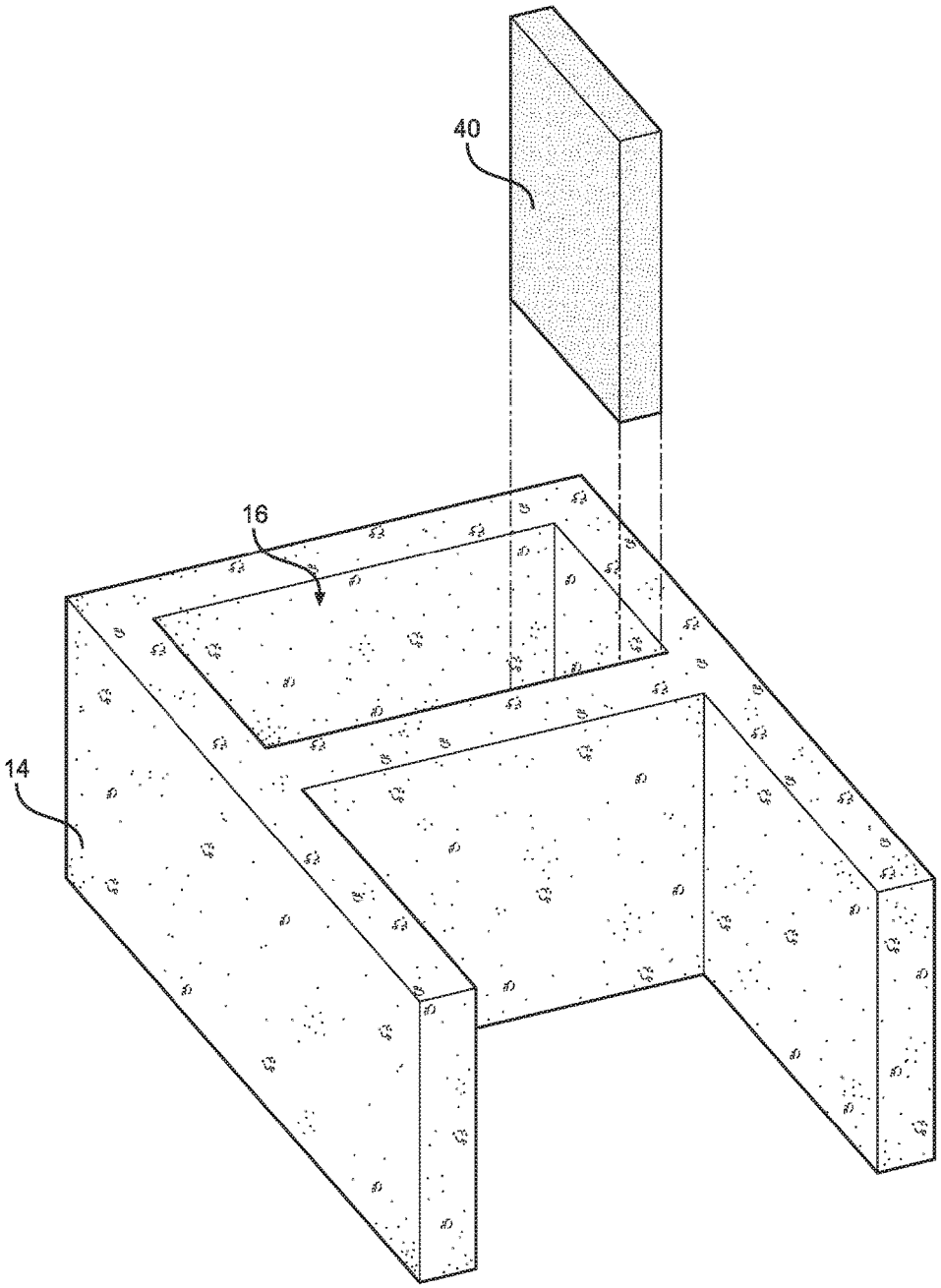
FIG. 8 shows the insulation panel of FIG. 7 being installed in a concrete block.
Figure 9:
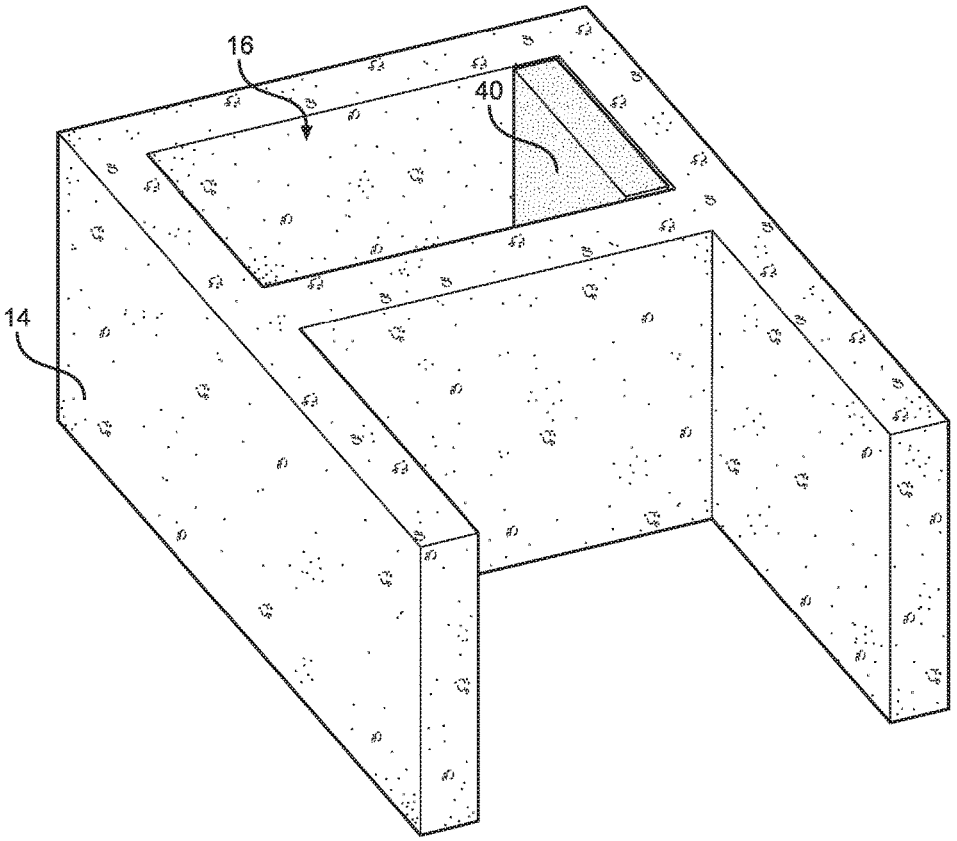
FIG. 9 shows the insulation panel of FIG. 7 installed in a concrete block.

As seen in FIGS. 8 and 9, the panel 40 is sized and configured as a rectangle to conform to the closed end 16 of the concrete block 14. The panel 40 is desirably made of the same type of foam material as described for the foam material 20 above. A single one of the panels 40 may be utilized, or several of the panels 40 may be utilized in the closed end 16.

As configured and made using a suitable foam material, the panel 40 is suitable for installation into the closed end 16 of the concrete block 14 at a plant where the concrete block 14 is made, and has sufficient properties, such as firmness, resilience, and coefficient of static friction, to remain firmly installed in the concrete block 14 during shipping and handling of the concrete block.

Figure 10:
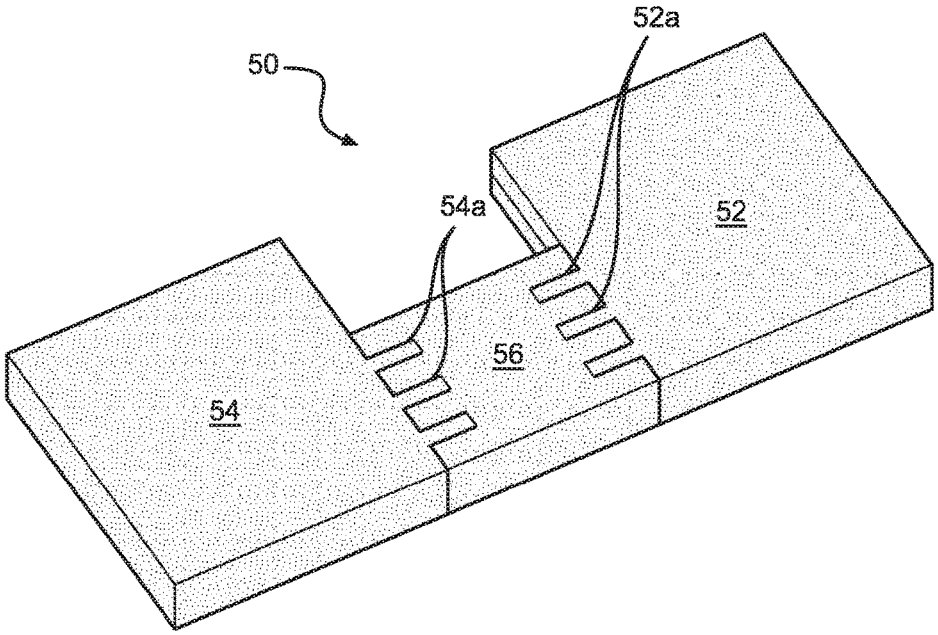
FIG. 10 shows an alternate embodiment of an insulation system according to the disclosure for an open end of a concrete block.
Figure 11:
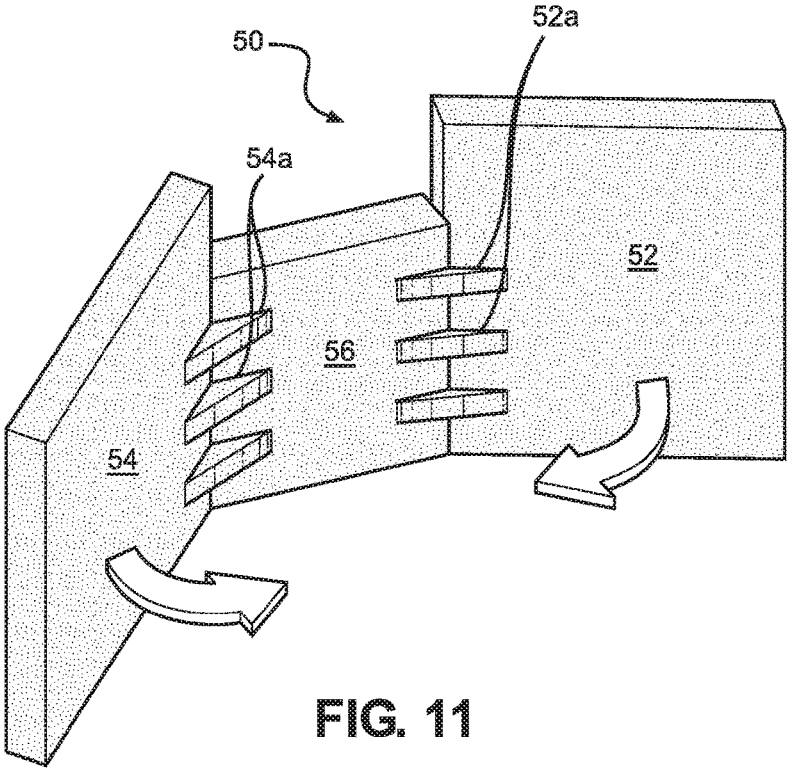
FIG. 11 depicts folding of the insulation system of FIG. 10.
Figure 12:
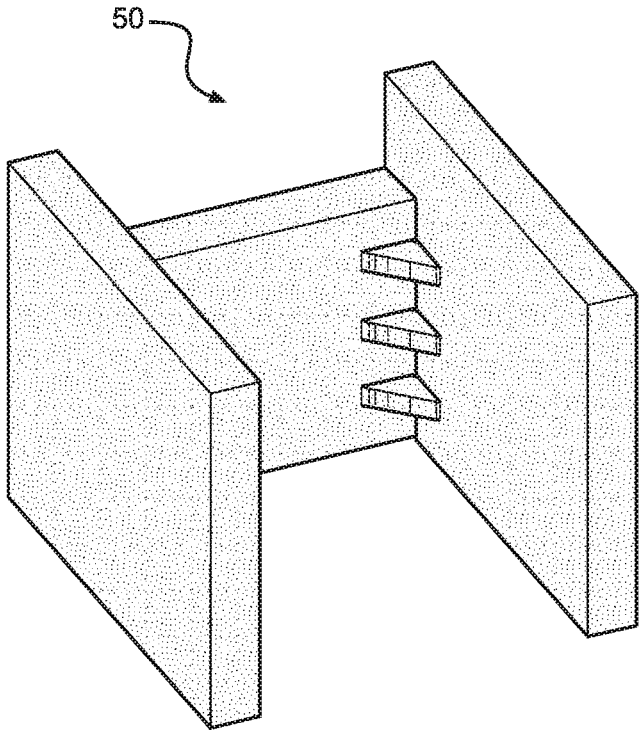
FIG. 12 shows the insulation system of FIG. 10 after it has been folded.
Figure 13:
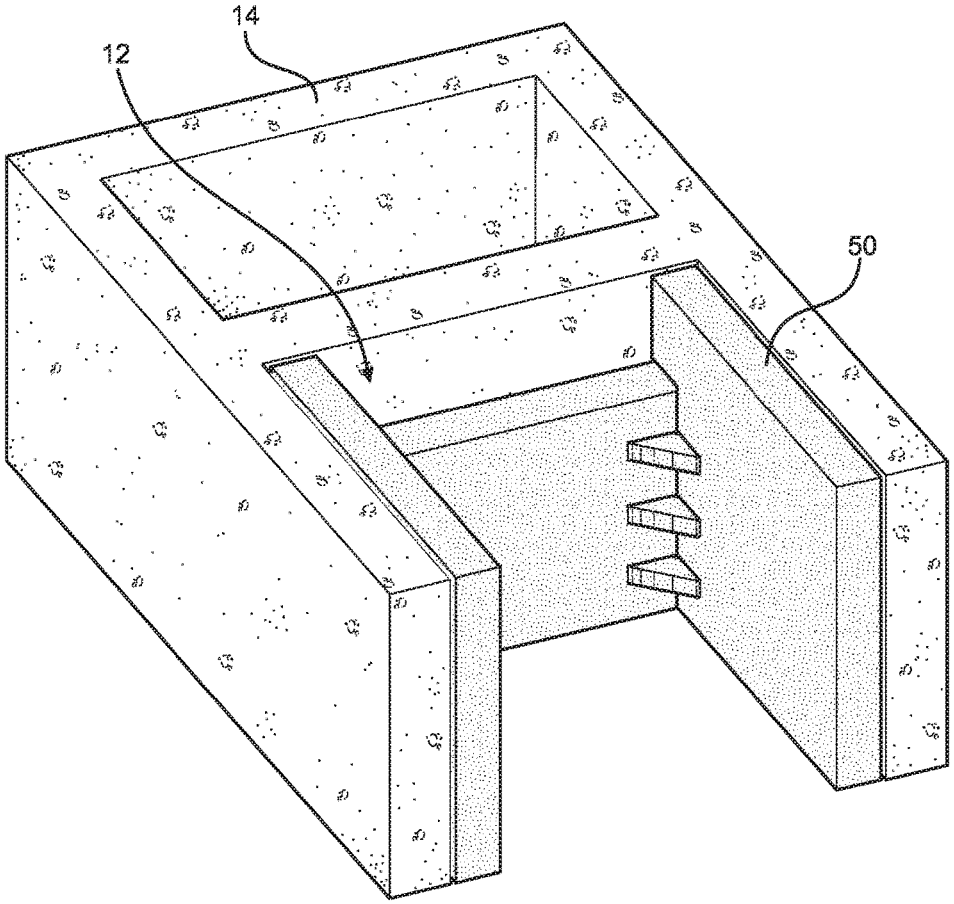
FIG. 13 shows the shows the insulation system of FIG. 10 as installed into an open end of a concrete block.

FIGS. 10-13 show an alternate embodiment of an insulation system 50 configured for being located in the open end 12 of the concrete block 14. FIG. 10 shows the system 50 in a flat or unfolded orientation. FIG. 11 depicts folding of the insulation system 50. FIG. 12 shows the insulation system 50 folded. FIG. 13 shows the insulation system 50 as installed into the open end 12 of the concrete block 14.

The insulation system 50 is identical to the insulation system 10, except in the structure that provides a hinge to enable folding. The insulation system 50 is provided by a single sheet of foam material (preferably the same material as the foam material 20). The material of the system 50 is configured to have opposite end portions 52 and 24, with a middle portion 56 intermediate the end portions 52 and 54. The end portions 52 and 54 are preferably of like dimension and configured to correspond in dimension to the sides of the open end 12 of the concrete block 14.

Slits 52*a* are defined on the middle portion 56 adjacent the end portion 52, and slits 54*a* are defined on the middle portion 56 adjacent the end portion 54. The slits 52*a* and 54*a* provide a hinge structure to enable the system 50 to be folded or erected to that the middle portion 56 is disposed perpendicular to the end portions 52 and 54 to render the system 50 in a u-shaped orientation as shown in FIG. 12 for insertion into the open end 12 of the concrete block 14 as shown in FIG. 13.

The foregoing description of preferred embodiments for this disclosure have been presented for purposes of illustration and description. They are not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

The invention claimed is:

1. An insulation system for a concrete block having an open end and a closed end, the insulation system comprising:

a single sheet of a foam material configured to have opposite end portions with a middle portion intermediate the end portions and a hinge defined between each of the end portions and the middle portion to enable the sheet to be folded so that the middle portion is disposed perpendicular to the end portions to render the sheet in a u-shaped orientation so as to be insertable into the open end of the concrete block, the closed cell foam having a density of from about 0.5 to about 3.0 lb/ft3, a cell count of from about 10 to about 40 cells/inch, a compressive strength at a 25% deflection of from about 1 to about 10, a compressive strength at 50% of from about 4 to about 20, a water absorption of about 0.25 lb/ft2 or less, a tensile strength of about 10 lb/in2 or more, and a tensile elongation of about 25% or more; and a panel of foam material configured as a rectangle to conform to the closed end of the concrete block, wherein the sheet of foam material is sized to provide a snug interference fit with the open end of the concrete block when folded into the u-shaped orientation and the panel is sized to provide a snug interference fit with the closed end of the concrete block, and wherein the sheet of foam material and the panel of foam material each comprise a closed cell flexible foam.

2. The insulation system of claim 1, wherein the hinge comprises a channel defined on each of the end portions adjacent the middle portion configured to provide clearance for ends of the middle portion to be received to enable the sheet to be folded.

3. The insulation system of claim 1, wherein the hinge comprises slits defined on the middle portion adjacent the end portions to enable the sheet to be folded.

4. An insulation system for a concrete block having an open end, the insulation system comprising:

a single sheet of a foam material comprising a sheet of a closed cell flexible foam configured to have opposite end portions with a middle portion intermediate the end portions and a hinge defined between each of the end portions and the middle portion to enable the sheet to be folded so that the middle portion is disposed perpendicular to the end portions to render the sheet in a u-shaped orientation so as to be insertable into the open end of the concrete block, the sheet of foam material being sized to provide a snug interference fit with the open end of the concrete block when folded into the u-shaped orientation, the closed cell foam having a density of from about 0.5 to about 3.0 lb/ft3, a cell count of from about 10 to about 40 cells/inch, a compressive strength at a 25% deflection of from about 1 to about 10, a compressive strength at 50% of from about 4 to about 20, a water absorption of about 0.25 lb/ft2 or less, a tensile strength of about 10 lb/in2 or more, and a tensile elongation of about 25% or more.

5. The insulation system of claim 4, wherein the hinge comprises a channel defined on each of the end portions adjacent the middle portion configured to provide clearance for ends of the middle portion to be received to enable the sheet to be folded.

6. The insulation system of claim 4, wherein the hinge comprises slits defined on the middle portion adjacent the end portions to enable the sheet to be folded.

7. An insulation system for a concrete block having an opening, the insulation system comprising:

a closed cell flexible foam has a density of from about 0.5 to about 3.0 lb/ft3, a cell count of from about 10 to about 40 cells/inch, a compressive strength at a 25% deflection of from about 1 to about 10, a compressive strength at 50% of from about 4 to about 20, a water absorption of about 0.25 lb/ft2 or less, a tensile strength of about 10 lb/in2 or more, and a tensile elongation of about 25% or more, wherein the foam is configured to snugly fit within the opening for installation of the foam, and wherein the installed foam remains installed within the opening during transport of the concrete block.

8. A method for providing insulation for a concrete block at a concrete block plant where the block is manufactured, the method comprising the steps of:

providing a concrete block having an open end at the plant;

providing insulation for the block, comprising providing a single sheet of a foam material comprising a sheet of a closed cell flexible foam configured to have opposite end portions with a middle portion intermediate the end portions and a hinge defined between each of the end portions and the middle portion to enable the sheet to be folded so that the middle portion is disposed perpendicular to the end portions to render the sheet in a u-shaped orientation so as to be insertable into the open end of the concrete block, the closed cell foam having a density of from about 0.5 to about 3.0 lb/ft3, a cell count of from about 10 to about 40 cells/inch, a compressive strength at a 25% deflection of from about 1 to about 10, a compressive strength at 50% of from about 4 to about 20, a water absorption of about 0.25 lb/ft2 or less, a tensile strength of about 10 lb/in2 or more, and a tensile elongation of about 25% or more, folding the sheet of foam material to provide the sheet in the u-shaped orientation;

installing the sheet material in the u-shaped orientation into the open end; and transporting the block with the installed sheet material, wherein the installed sheet material remains firmly installed in the concrete block during transport of the concrete block.

9. The method of claim 8, wherein the hinge comprises a channel defined on each of the end portions adjacent the middle portion configured to provide clearance for ends of the middle portion to be received to enable the sheet to be folded.

10. The method of claim 8, wherein the hinge comprises slits defined on the middle portion adjacent the end portions to enable the sheet to be folded.

11. A method for providing insulation for a concrete block, the method comprising the steps of: providing a concrete block; providing insulation for the block, comprising providing a closed cell foam dimensioned to snugly fit within an opening of the block, the foam having a density of from about 0.5 to about 3.0 lb/ft3, a cell count of from about 10 to about 40 cells/inch, a compressive strength at a 25% deflection of from about 1 to about 10, a compressive strength at 50% of from about 4 to about 20, a water absorption of about 0.25 lb/ft2 or less, a tensile strength of about 10 lb/in2 or more, and a tensile elongation of about 25% or more; installing the foam within the opening of the concrete block; and transporting the concrete block with the installed foam, wherein the installed foam remains firmly installed in the concrete block during transport of the concrete block.

* * * * *